US012234829B2

(12) United States Patent
Nishimura

(10) Patent No.: US 12,234,829 B2
(45) Date of Patent: Feb. 25, 2025

(54) VACUUM PUMP AND ADJUSTMENT METHOD

(71) Applicant: SHIMADZU CORPORATION, Kyoto (JP)

(72) Inventor: Taiki Nishimura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 18/764,264

(22) Filed: Jul. 4, 2024

(65) Prior Publication Data

US 2025/0020133 A1 Jan. 16, 2025

(30) Foreign Application Priority Data

Jul. 14, 2023 (JP) ..... 2023-116265

(51) Int. Cl.
*F04D 19/04* (2006.01)
*F04D 29/058* (2006.01)

(52) U.S. Cl.
CPC ..... *F04D 19/048* (2013.01); *F04D 19/042* (2013.01); *F04D 29/058* (2013.01)

(58) Field of Classification Search
CPC ..... F04D 19/04; F04D 19/042; F04D 19/048; F04D 29/058; F16C 2360/45
See application file for complete search history.

(56) References Cited

U.S. PATENT DOCUMENTS

2019/0383301 A1* 12/2019 Manabe ..... F04D 19/042
2020/0116155 A1* 4/2020 Nishimura ..... F04D 19/042

FOREIGN PATENT DOCUMENTS

GB 2621343 A * 2/2024 ..... F04D 19/042
JP 2020-122529 A 8/2020
WO WO-2018096357 A1 * 5/2018 ..... F04D 19/042

* cited by examiner

*Primary Examiner* — David E Sosnowski
*Assistant Examiner* — Maxime M Adjagbe
(74) *Attorney, Agent, or Firm* — Renner, Otto, Boisselle & Sklar, LLP

(57) ABSTRACT

A vacuum pump includes a housing, a magnetic bearing, and a magnet nut. The magnetic bearing has a first permanent magnet arranged at the periphery of a magnet holder and a second permanent magnet arranged in the rotor to face the first permanent magnet in a radial direction. The magnet nut has a main body portion and protrusions. The main body portion adjusts the position of the first permanent magnet relative to the second permanent magnet by rotating relative to the magnet holder. The protrusion protrudes from an upper surface of the main body portion, and has contact target surfaces contactable with a first tool configured to rotate the main body portion from the upper surface side of the main body portion and contactable with a second tool configured to rotate the main body portion from the outer periphery side of the main body portion.

9 Claims, 12 Drawing Sheets

VACUUM PUMP AND ADJUSTMENT METHOD

This application claims priority under 35 U.S.C. § 119 to Japanese Patent Application No. 2023-116265 filed on Jul. 14, 2023. The entire disclosure of Japanese Patent Application No. 2023-116265 is hereby incorporated herein by reference.

BACKGROUND OF THE INVENTION

1. Technical Field

The present invention relates to a vacuum pump and an adjustment method thereof.

2. Background Art

A turbo-molecular pump is used as, e.g., a vacuum pump for ultra-high vacuum or a vacuum pump for a leak detector. For example, a vacuum pump described in JP-A-2020-122529 is configured such that a rotor is housed in a housing and vacuum pumping is performed by rotating the rotor at tens of thousands of revolutions.

In the vacuum pump described in JP-A-2020-122529, the rotor is rotatably supported on the housing by a magnetic bearing and a rolling bearing. The magnetic bearing includes a rotary-side magnet arranged in the rotor and a stationary-side magnet arranged in a magnet holder fixed to the housing. The rolling bearing needs to be applied with a preload in order to reduce rattling and noise upon rotation. By adjustment of the position of the rotary-side magnet relative to the stationary-side magnet, a proper preload can be applied to the rolling bearing.

The position of the rotary-side magnet is adjusted in such a manner that a magnet nut screwed to the magnet holder is rotated. The housing is formed with a suction port in a portion above the magnet nut, and a worker can rotate the magnet nut through the suction port.

SUMMARY OF THE INVENTION

In a vacuum pump used for a leak detector, a suction port is not provided in a portion above a magnet nut, and is formed in a portion at the side of the magnet nut in some cases. Moreover, in some cases, a rotor is housed in a housing (referred to as an adjustment housing) different from a housing of the vacuum pump, and the rotation balance of the rotor in the vacuum pump is adjusted. The adjustment housing is also provided with a stationary-side magnet, and in a case where the rotor is housed in the adjustment housing, the position of the stationary-side magnet is also adjusted by the magnet nut.

A typical magnet nut can be held with a tool for rotating the magnet nut only from the side or above. For this reason, a common magnet nut cannot be used between the housing of the vacuum pump and the adjustment housing.

The object of the present invention is to adjust, in a vacuum pump having a stationary-side magnet, the position of the stationary-side magnet not only from the side but also from above a housing.

A vacuum pump according to one aspect of the present invention includes a rotor, a housing, a magnetic bearing, and an adjustment member. The rotor is rotatable. The housing houses the rotor. The magnetic bearing has a first magnet arranged at the periphery of a magnet holder fixed to the housing and a second magnet arranged in the rotor to face the first magnet in a radial direction. The adjustment member adjusts the position of the first magnet relative to the second magnet. The adjustment member has a main body portion and a protrusion. The main body portion has, in the inner peripheral surface thereof, a second thread shape to be fitted in a first thread shape formed at the periphery of the magnet holder, and is moved in a direction along the rotation axis of the rotor by rotating relative to the magnet holder to adjust the position of the first magnet relative to the second magnet. The protrusion protrudes from the upper surface of the main body portion. The protrusion has, on the outer peripheral side of the main body portion, a contact target surface contactable with a first tool configured to rotate the main body portion from the upper-surface side of the main body portion and contactable with a second tool configured to rotate the main body portion from the side-surface side of the main body portion.

In the above-described vacuum pump, the protrusion protruding from the upper surface of the main body portion of the adjustment member for adjusting the position of the first magnet has the contact target surface contactable with the tool configured to rotate the main body portion. The contact target surface is provided on the outer peripheral side of the main body portion at the protrusion, and is contactable not only with the first tool for rotating the main body portion from the upper-surface side of the main body portion but also with the second tool for rotating the main body portion from the side-surface side of the main body portion. As described above, the adjustment member can be rotated with the tool not only from the upper-surface side but also from the side-surface side of the main body portion, and therefore, the position of the first magnet can be adjusted not only from the upper-surface side but also from the side-surface side of the adjustment member.

DETAILED DESCRIPTION OF THE EXEMPLARY EMBODIMENTS

1. First Embodiment

<1-1. Configuration of Vacuum Pump>

Figure 1:
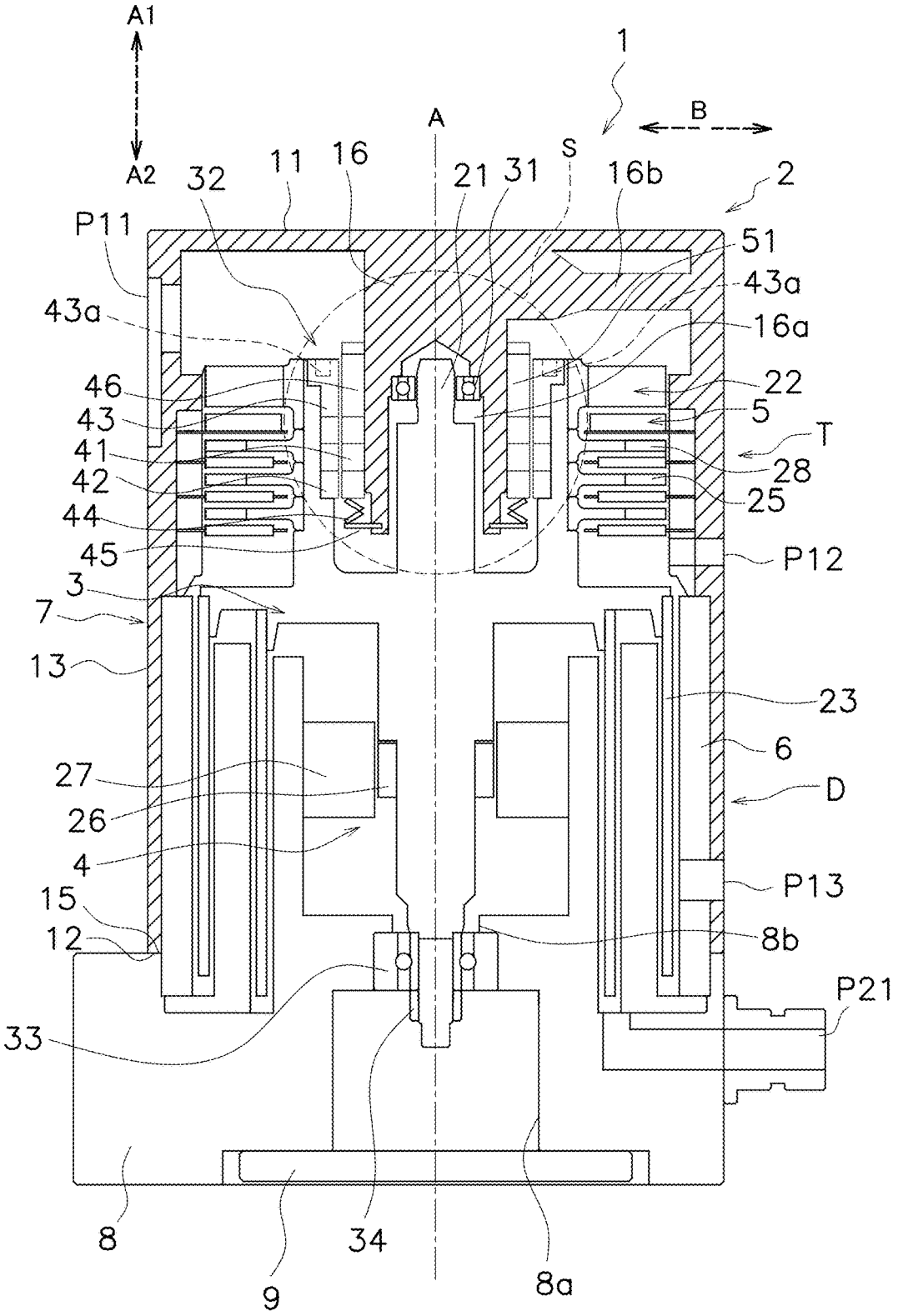
FIG. 1 is a sectional view of a vacuum pump.
Figure 2:
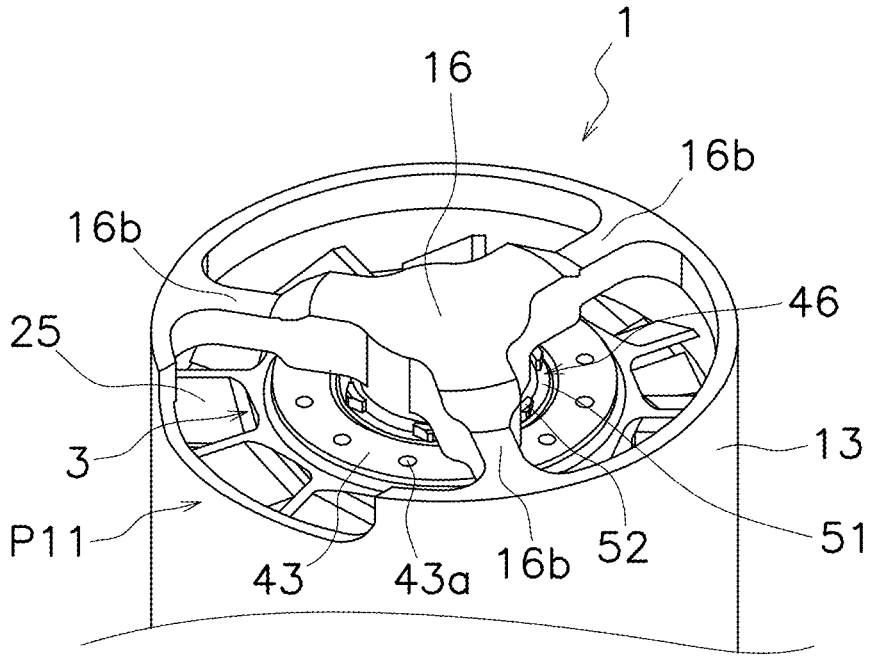
FIG. 2 is a top perspective view of the vacuum pump.

Hereinafter, a vacuum pump 1 according to an embodiment of the present disclosure will be described with reference to the drawings such as FIGS. 1 and 2. FIG. 1 is a sectional view of the vacuum pump 1. FIG. 2 is a top perspective view of the vacuum pump 1. The vacuum pump 1 has a housing 2, a rotor 3, a motor 4, a plurality of stator blade units 5, and a stator cylindrical portion 6.

The housing 2 houses the rotor 3, the motor 4, the plurality of stator blade units 5, and the stator cylindrical portion 6. The housing 2 has a case 7 and a base 8. The housing 2 is made of metal such as aluminum alloy or iron. The case 7 is a tubular member.

The case 7 houses the plurality of stator blade units 5 and plural stages of rotor blade units 22 provided in the rotor 3. The case 7 has a first end portion 11, a second end portion 12, and a side portion 13. The first end portion 11 is arranged perpendicularly to an axis A of the rotor 3 to cover the rotor 3. Note that in FIG. 2, the first end portion 11 is omitted.

The second end portion 12 is positioned opposite to the first end portion 11 in the direction of the axis A of the rotor 3. The second end portion 12 is connected to the base 8. The side portion 13 connects the first end portion 11 and the second end portion 12 to each other. The side portion 13 of the case 7 is formed with a first suction port P11 and second suction ports P12, P13. The first suction port P11 is formed in the vicinity of the first end portion 11 in the side portion 13. A pumping target device including a pumping target space is connected to the first suction port P11.

The base 8 is arranged to close an opening of the case 7 on the second end portion 12 side. The case 7 and the base 8 house the stator cylindrical portion 6 and a rotor cylindrical portion 23 provided in the rotor 3. The base 8 has a base end portion 15. The base end portion 15 is connected to the second end portion 12 of the case 7. Note that connection between the case 7 and the base 8 includes joint between separate members and continuous formation of separate portions of an integrated member.

The side surface of the base 8 is formed with an exhaust port P21. An auxiliary pump is connected to the exhaust port P21. In an internal space of the housing 2, an exhaust path from the first suction port P11 to the exhaust port P21 is formed. The plurality of second suction ports P12, P13 is connected to the exhaust path. When the vacuum pump 1 is used as a leak detector, pipes from test samples are each connected to the plurality of second suction ports P12, P13. The second suction port P12 is formed between a turbine portion T and a drag pump portion D. The second suction port P13 is formed in the middle of the drag pump portion D. Note that the second suction ports P12, P13 are not necessarily formed depending on the use application of the vacuum pump 1.

The rotor 3 has a shaft 21, the plural stages of rotor blade units 22, and the rotor cylindrical portion 23. The shaft 21 extends in the direction of the axis A of the rotor 3. In description below, a direction from the base 8 to the case 7 in the direction of the axis A will be referred to as a first direction A1, and the opposite direction thereof will be referred to as a second direction A2.

The vacuum pump 1 has a magnet holder 16. The magnet holder 16 is arranged inside the case 7. The magnet holder 16 is arranged to extend from the first end portion 11 of the case 7 to the base 8. The magnet holder 16 is formed integrally with the case 7. Integral formation includes, for example, molding from the same material with a mold and formation by cutting.

The magnet holder 16 has a circular columnar outer shape. The end of the magnet holder 16 on the second direction A2 side is formed with a recess 16*a* in the first direction A1. The end of the shaft 21 on the first direction A1 side is inserted into the recess 16*a*.

The magnet holder 16 has beam portions 16*b*. Three beam portions 16*b* are provided at equal intervals along the circumferential direction of the magnet holder 16. The beam portions 16*b* are bridged between the magnet holder 16 and the side portion 13 of the case 7. With this configuration, the beam portions 16*b* can support the magnet holder 16 on the side portion 13. That is, the beam portions 16*b* fix the magnet holder 16 in a state of a constant distance to the side portion 13 being held.

The surface of the base 8 on the second direction A2 side is formed, at the center thereof, with a recess 8*a* in the first direction A1. The vacuum pump 1 has a lid 9. The lid 9 is arranged to close the recess 8*a* of the base 8.

A ceiling portion of the recess 8*a* of the base 8 on the first direction A1 side is formed with a through-hole 8*b* along the direction of the axis A. The shaft 21 is inserted into the through-hole 8*b*, and the end of the shaft 21 on the second direction A2 side protrudes into the recess 8*a*.

The vacuum pump 1 has a protective bearing 31, a magnetic bearing 32, and a rolling bearing 33. The protective bearing 31 is arranged between the magnet holder 16 and the shaft 21. The protective bearing 31 is arranged inside the recess 16*a* of the magnet holder 16. The protective bearing 31 functions as a touchdown bearing that limits radial runout of the shaft 21 on the first direction A1 side. In a state of the shaft 21 being in steady rotation, the shaft 21 and the protective bearing 31 do not contact each other. In a case where great disturbance is applied or a case where whirling of the shaft 21 becomes greater upon acceleration or deceleration of rotation, The shaft 21 contacts the inner surface of an inner ring of the protective bearing 31. For example, a ball bearing can be used as the protective bearing 31.

The magnetic bearing 32 is arranged between the magnet holder 16 and the rotor 3. The magnetic bearing 32 contactlessly supports the rotor 3. The magnetic bearing 32 will be described in detail later.

The rolling bearing 33 is arranged between the shaft 21 and the base 8. The rolling bearing 33 rotatably supports the shaft 21 on the base 8. The rolling bearing 33 is arranged in the through-hole 8*b* of the base 8. For example, a ball bearing can be used as the rolling bearing 33. The vacuum pump 1 has a thrust nut 34 fixed to the shaft 21. The thrust nut 34 is arranged on a portion of the shaft 21 protruding from the through-hole 8*b* and positioned inside the recess 8*a*. The thrust nut 34 is arranged on the second direction A2 side of the rolling bearing 33. When the later-described magnetic bearing 32 is adjusted, force of moving the rotor 3 toward the case 7 is applied to the rotor 3, and accordingly, the thrust nut 34 applies a preload to the rolling bearing 33 in the first direction A1.

The plural stages of rotor blade units 22 are connected to the shaft 21. The plural stages of rotor blade units 22 are arranged at intervals in the direction of the axis A. Each rotor blade unit 22 includes a plurality of rotor blades 25. The plurality of rotor blades 25 radially extends about the shaft 21. Note that in the drawing, reference numerals are assigned only to one of the plural stages of rotor blade units 22 and one of the plurality of rotor blades 25 and no reference numerals are assigned to the other rotor blade units 22 and the other rotor blades 25.

The rotor cylindrical portion 23 is connected to the shaft 21. The rotor cylindrical portion 23 is arranged below the rotor blade units 22. The rotor cylindrical portion 23 is in a cylindrical shape, and extends in the direction of the axis A. The rotor cylindrical portion 23 is arranged to surround the shaft 21 on the outer peripheral side of the shaft 21. The outer peripheral surface of the rotor cylindrical portion 23 is a tubular curved surface.

The motor 4 rotationally drives the rotor 3. For example, a brushless motor is used as the motor 4. The motor 4 has a motor rotor 26 and a motor stator 27. The motor rotor 26 is attached to the shaft 21. The motor stator 27 is attached to the base 8. The motor stator 27 is arranged to face the motor rotor 26.

The plural stages of stator blade units 5 are connected to the inner surface of the case 7. The plural stages of stator blade units 5 are arranged at intervals in the direction of the axis A. Each of the plural stages of stator blade units 5 is arranged between adjacent ones of the plural stages of rotor blade units 22. Each stator blade unit 5 includes a plurality of stator blades 28. Although not shown in the figure, the plurality of stator blades 28 radially extends about the shaft 21.

The plural stages of rotor blade units 22 and the plural stages of stator blade units 5 form the turbine portion T (turbo-molecular pump). Note that in the drawing, reference numerals are assigned only to one of the plurality of stator blade units 5 and one of the plurality of stator blades 28 and no reference numerals are assigned to the other stator blade units 5 and the other stator blades 28.

The stator cylindrical portion 6 is arranged outside the rotor cylindrical portion 23 in the radial direction. The stator cylindrical portion 6 is connected to the base 8. The stator cylindrical portion 6 is arranged to face the rotor cylindrical portion 23 in the radial direction of the rotor cylindrical portion 23.

The inner peripheral surface of the stator cylindrical portion 6 is provided with a spiral screw groove. The rotor cylindrical portion 23 and the stator cylindrical portion 6 form the drag pump portion D (screw groove pump). In the vacuum pump 1, gas from the pumping target space of the pumping target device is discharged by the turbine portion T, and thereafter, is discharged by the drag pump portion D. Then, the gas is discharged to the outside of the vacuum pump 1.

<1-2. Configuration of Magnetic Bearing>

Figure 3:
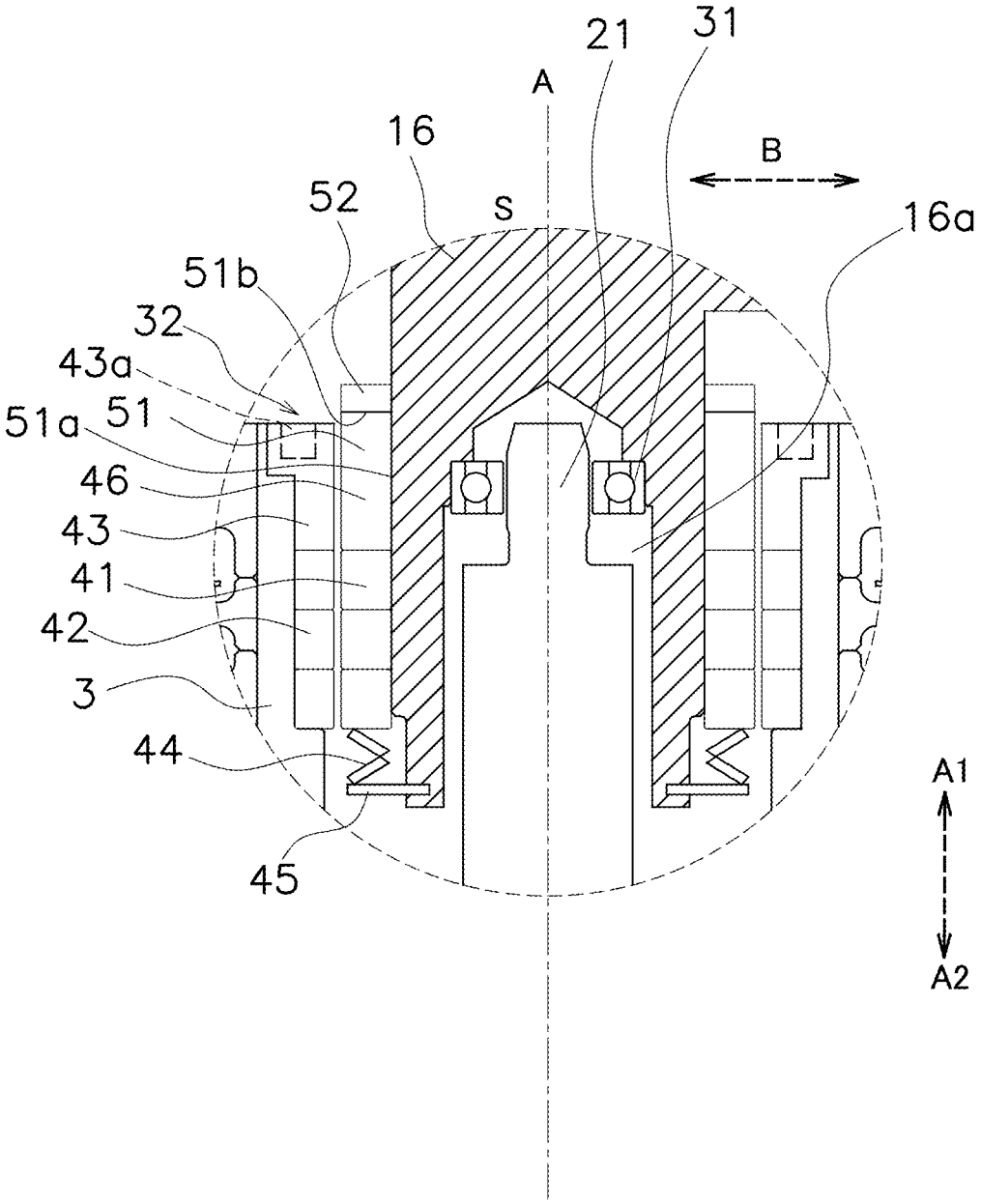
FIG. 3 is an enlarged view of a portion S of FIG. 1.

Hereinafter, the configuration of the magnetic bearing 32 will be described with reference to FIGS. 1 to 3. FIG. 3 is an enlarged view of a portion S of FIG. 1. The magnetic bearing 32 has a first permanent magnet 41 (one example of a first magnet) and a second permanent magnet 42 (one example of a second magnet). The first permanent magnet 41 is arranged on the outer peripheral surface of the magnet holder 16. The second permanent magnet 42 is fixed to the inner peripheral surface of the rotor 3. The first permanent magnet 41 and the second permanent magnet 42 are arranged to face each other in a radial direction B.

The first permanent magnet 41 and the second permanent magnet 42 are in a ring shape. FIG. 1 shows three first permanent magnets 41 and three second permanent magnets 42 arranged along the direction of the axis A, but the number of first permanent magnets 41 and the number of second permanent magnets 42 are not particularly limited.

A clearance is formed between the first permanent magnet 41 and the second permanent magnet 42. Each of ring-shaped magnet elements forming the first permanent magnet 41 and the second permanent magnet 42 is arranged such that one end in the direction of the axis A is an N-pole and the other end is an S-pole. The ring-shaped magnet elements of the first permanent magnets 41 stacked on each other are arranged such that the N-poles or the S-poles face each other in the direction of the axis A. The ring-shaped magnet elements of the second permanent magnets 42 stacked on each other are arranged such that the N-poles or the S-poles face each other in the direction of the axis A. The first permanent magnet 41 and the second permanent magnet 42 are arranged such that the same polarities substantially face each other, but due to positional displacement in the direction of the axis A, force of moving the shaft 21 in the first direction A1 relative to the case 7 and the base 8 is applied to the shaft 21 and the thrust nut 34 applies the preload to the rolling bearing 33 accordingly. The preload can be adjusted by adjustment of the amount of positional displacement of the first permanent magnet 41 in the direction of the axis A relative to the second permanent magnet 42.

The vacuum pump 1 further has a fixing member 43, a disc spring 44, a spring support member 45, and a magnet nut 46.

The fixing member 43 is arranged on the surface of the second permanent magnet 42 on the first direction A1 side. The fixing member 43 is in a ring shape. The fixing member 43 is fixed to the rotor 3. The fixing member 43 is a pressing member for fixing the position of the second permanent magnet 42. The fixing member 43 is fixed to the rotor 3 by, e.g., shrink fit or cooling fit.

An end portion of the fixing member 43 in the first direction A1, i.e., an upper end portion of the fixing member 43, is provided with a plurality of balance adjustment holes 43*a*. The plurality of balance adjustment holes 43*a* is provided along the circumferential direction of the fixing member 43. A thread to be screwed by a screw is formed in each of the plurality of balance adjustment holes 43*a*. The position of the center of gravity of the rotor 3 can be adjusted in such a manner that the screw is screwed into any of the plurality of balance adjustment holes 43*a*. The position of the center of gravity of the rotor 3 is adjusted so that vibration upon rotation of the rotor 3 can be reduced.

The disc spring 44 is arranged on the second direction A2 side of the first permanent magnet 41. The end of the disc spring 44 opposite to the first permanent magnet 41 is supported by the spring support member 45 fixed to the magnet holder 16. The disc spring 44 as an elastic body elastically supports the first permanent magnet 41 between the spring support member 45 and the magnet nut 46 arranged on the surface of the first permanent magnet 41 on the first direction A1 side. Note that a shim ring may be arranged between the disc spring 44 and the first permanent magnet 41.

<1-3. Configuration of Magnet Nut>

The magnet nut 46 (one example of an adjustment member) is in a ring shape. The magnet nut 46 is arranged on the surface of the first permanent magnet 41 on the first direction A1 side. The magnet nut 46 adjusts the position of the first permanent magnet 41 in the direction of the axis A. It can be said that the magnet nut 46 serves as a pressing member for receiving the pressure of the preload due to the repelling force of the magnet applied to the rolling bearing 33. The magnet nut 46 is movably arranged at the outer periphery of the magnet holder 16.

Figure 4:
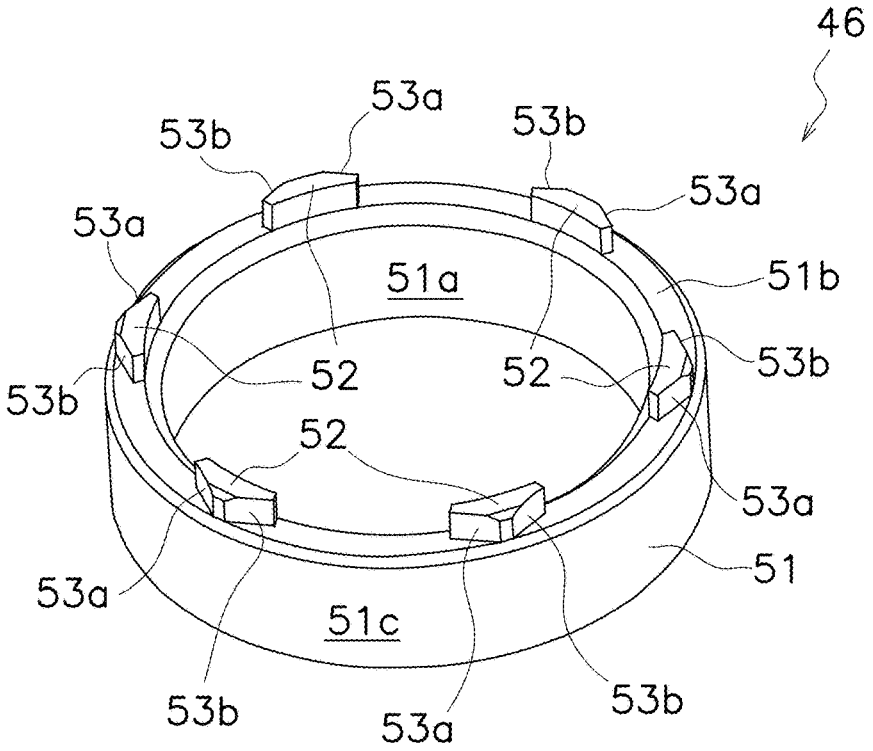
FIG. 4 is a perspective view of a magnet nut.
Figure 5:
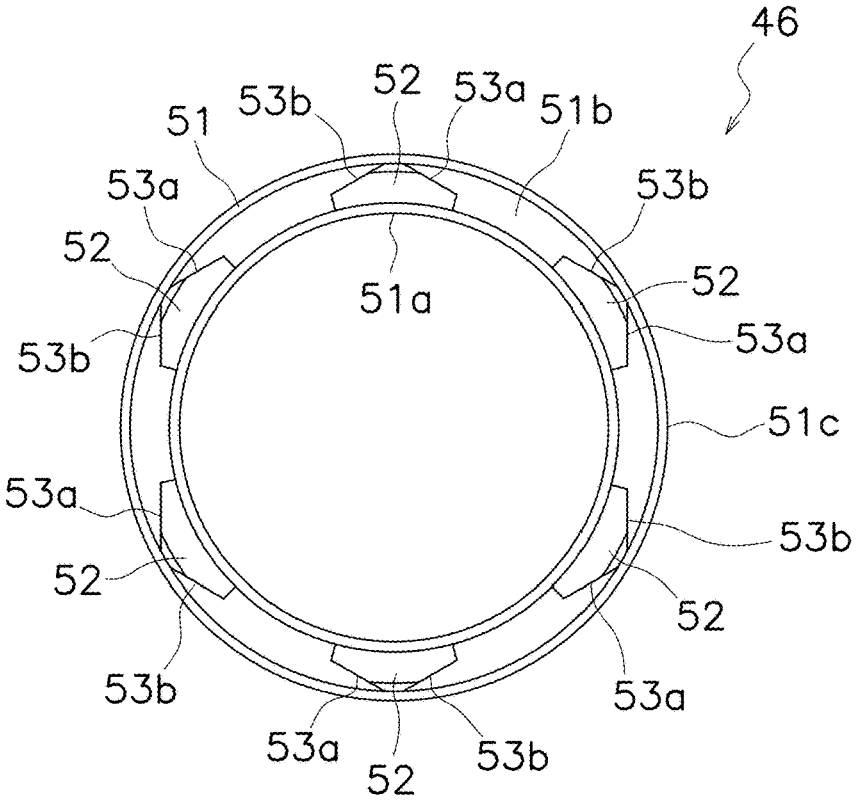
FIG. 5 is a top view of the magnet nut.
Figure 6:
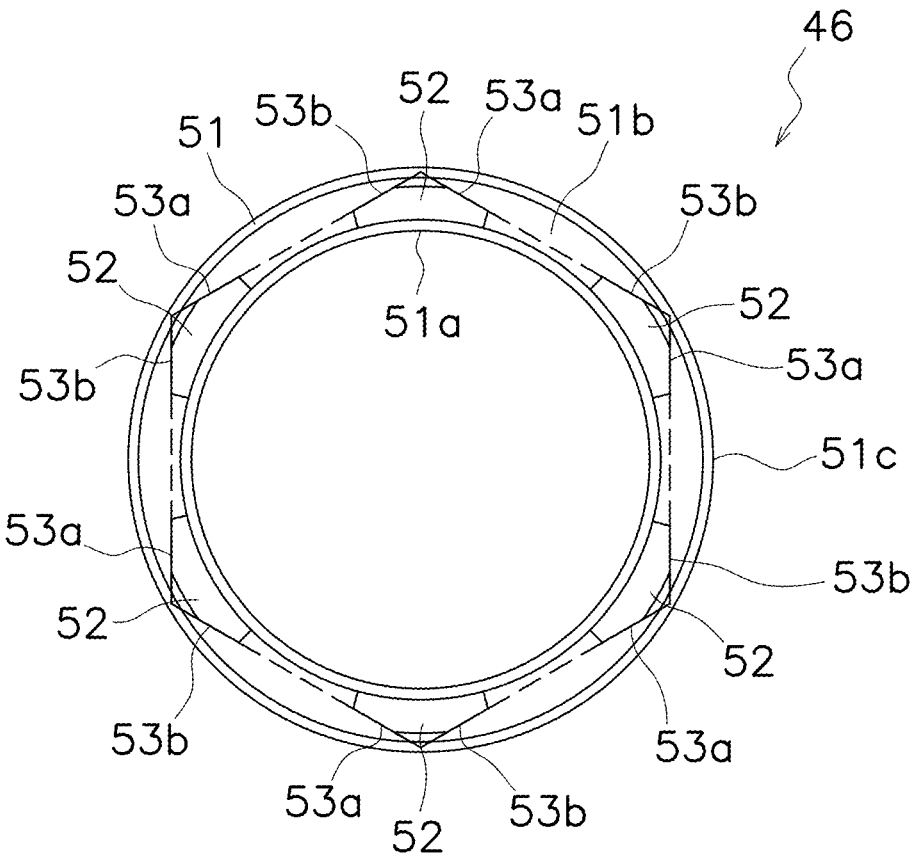
FIG. 6 is a view showing the state of arrangement of protrusions in the magnet nut.

Hereinafter, a specific configuration of the magnet nut 46 will be described with reference to FIGS. 4 to 6. FIG. 4 is a perspective view of the magnet nut 46. FIG. 5 is a top view of the magnet nut 46. FIG. 6 is a view showing the state of arrangement of protrusions 52 in the magnet nut 46. The magnet nut 46 has a main body portion 51 and the protrusions 52.

The main body portion 51 is a portion of the magnet nut 46 pressing the first permanent magnet 41. The main body portion 51 is in a ring shape. An internal thread shape (one example of a second thread shape) is formed in an inner periphery 51*a* of the main body portion 51. An external thread shape (one example of a first thread shape) is formed in the outer peripheral surface of the magnet holder 16. The internal thread shape of the main body portion 51 is fitted in the external thread shape of the outer peripheral surface of the magnet holder 16. That is, the main body portion 51 is screwed to the magnet holder 16, and is movable along the direction of the axis A by rotating in the circumferential direction relative to the magnet holder 16. Note that a spacer for protecting the first permanent magnet 41 may be arranged between the main body portion 51 and the first permanent magnet 41.

When the main body portion 51 rotates about the axis A relative to the magnet holder 16, the main body portion 51 moves in the direction of the axis A. The first permanent magnet 41 elastically supported by the disc spring 44 moves along the direction of the axis A by movement of the main body portion 51. That is, by rotation of the main body portion 51, the position of the first permanent magnet 41 relative to the second permanent magnet 42 can be adjusted.

The protrusion 52 protrudes in the first direction A1 from an upper surface 51*b* of the main body portion 51. The protrusion 52 is formed, on an outer periphery 51*c* side (i.e., side facing the rotor 3) of the main body portion 51, with a first contact target surface 53*a* and a second contact target surface 53*b* with which a tool (first tool 61 and second tool 62) for rotating the main body portion 51 is to contact. In the present embodiment, the six protrusions 52 are provided at equal intervals along the circumferential direction of the main body portion 51 on the upper surface 51*b* of the main body portion 51.

As viewed from the upper surface 51*b* side, the first contact target surface 53*a* extends from a portion corresponding to the vertex of a certain protrusion 52 on the outer periphery 51*c* side to the vertex of one of two protrusions 52 adjacent to the certain protrusion 52. On the upper surface 51*b* of the main body portion 51, the first contact target surface 53*a* diagonally extends from the outer periphery 51*c* side to the inner periphery 51*a* side of the main body portion 51.

As viewed from the upper surface 51*b* side, the second contact target surface 53*b* is a surface extending from the portion corresponding to the vertex of the certain protrusion 52 on the outer periphery 51*c* side to the vertex of the other one of the two protrusions 52 adjacent to the certain protrusion 52. On the upper surface 51*b* of the main body portion 51, the second contact target surface 53*b* diagonally extends from the outer periphery 51*c* side to the inner periphery 51*a* side of the main body portion 51.

The second contact target surface 53*b* is adjacent to the first contact target surface 53*a* of the protrusion 52 adjacent to the protrusion 52 provided with such a second contact target surface 53*b*. Thus, the second contact target surface 53*b* and the first contact target surface 53*a* adjacent thereto are arranged on one common side of a hexagon formed by the six protrusions 52.

As shown in FIGS. 4 to 6, the protrusion 52 is smaller than the main body portion 51. The contact target surfaces 53*a*, 53*b* with which the tool is to contact are formed at the smaller protrusion 52 as described above, so that the magnet nut 46 can be held with the tool and can be reduced in size. Since the magnet nut 46 is reduced in size, the characteristic value of the vacuum pump 1 is not decreased and great vibrations are less likely to occur in the vacuum pump 1. Further, the percentage of the magnet nut 46 in the case 7 can be decreased, and therefore, the large first permanent magnet 41 (and the large second permanent magnet 42) can be used in the vacuum pump 1 and the exhaust speed of the vacuum pump 1 can be increased.

In the present embodiment, the six protrusions 52 are provided at equal intervals along the circumferential direction of the main body portion 51 on the upper surface 51*b* of the main body portion 51. Since the six protrusions 52 are provided at equal intervals along the circumferential direction of the main body portion 51, the six protrusions 52 form part of the hexagon as viewed from the upper surface 51*b* side of the main body portion 51, as shown in FIG. 6. Specifically, the vertex of the protrusion 52 on the outer periphery 51*c* side corresponds to the vertex of the hexagon, and the first contact target surface 53*a* and the second contact target surface 53*b* formed at the protrusions 52 correspond to the side extending from the vertex of the hexagon.

Hereinafter, a reason why the six (the multiple of six) protrusions 52 are provided on the upper surface 51*b* of the main body portion 51 will be described. As described later, the first tool 61 (FIG. 8) for rotating the magnet nut 46 from the upper surface 51*b* side of the main body portion 51 has three contact portions for contacting the contact target surfaces 53*a*, 53*b* of the protrusions 52 through three spaces formed by the three beam portions 16*b* provided in the magnet holder 16. In order for the first tool to stably hold the magnet nut 46, it is preferable that each of the three contact portions contacts the contact target surfaces 53*a*, 53*b* of at least one protrusion 52. Thus, the number of protrusions 52 provided on the upper surface 51*b* of the main body portion 51 is preferably the multiple of three.

On the other hand, the second tool 62 (FIG. 10) for rotating the magnet nut 46 from the side-surface side (outer periphery 51*c* side) of the main body portion 51 has two contact portions for contacting the contact target surfaces 53*a*, 53*b* of the protrusions 52. In order for the second tool to stably hold the magnet nut 46, it is preferable that each of the two contact portions contacts the contact target surfaces 53*a*, 53*b* of at least one of the protrusions 52. Thus, the number of protrusions 52 provided on the upper surface 51*b* of the main body portion 51 is preferably the multiple of two.

As a result, in order for both the first and second tools to stably hold the magnet nut 46, the number of protrusions 52 provided on the upper surface 51*b* of the main body portion 51 is preferably the multiple of two and the multiple of 3, i.e., the multiple of six (the common multiple of two and three).

<2. Balance Adjustment Housing>

Figure 7:
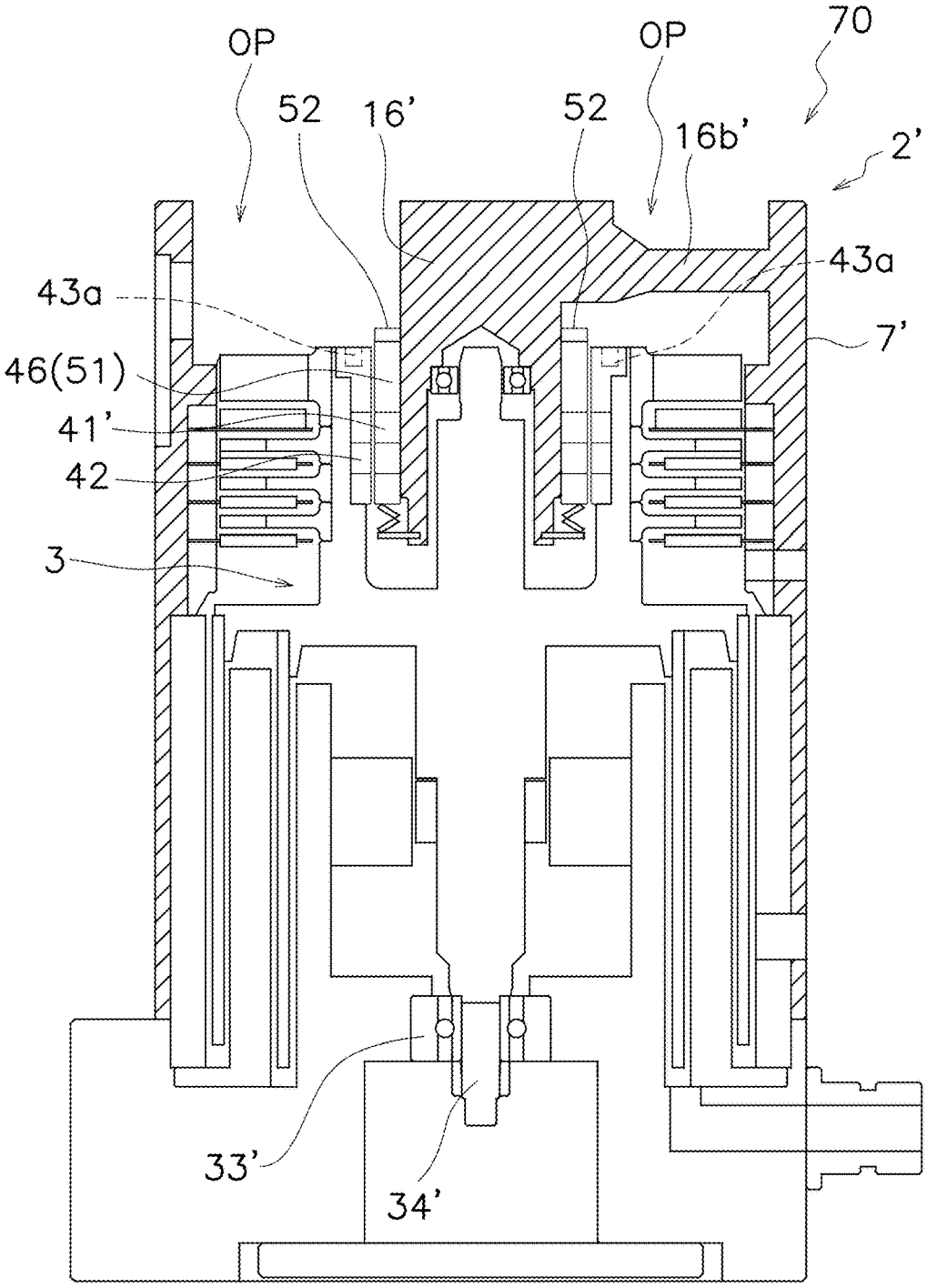
FIG. 7 is a view showing a balance adjustment housing.

Next, a balance adjustment housing 70 will be described. In the present embodiment, the balance of the rotor 3 is adjusted (the position of the center of gravity is adjusted) in a state that the rotor 3 is housed in the balance adjustment housing 70. Hereinafter, the configuration of the balance adjustment housing 70 will be described with reference to FIG. 7. FIG. 7 is a view showing the balance adjustment housing 70.

The balance adjustment housing 70 has a configuration similar to that of the vacuum pump 1 described above, except that a housing 2' has no first end portion and an opening OP through which an internal space of the housing 2' is accessible is provided in the upper surface of a case 7' of the housing 2'. Thus, description of other components of the balance adjustment housing 70 will be omitted.

Since the opening OP is provided in the case 7', a user can access the plurality of balance adjustment holes 43*a* from above the vacuum pump 1 through the opening OP, and can insert the screw into any of the balance adjustment holes 43*a* or detach the screw inserted into any of the balance adjustment holes 43*a*. In this manner, the balance of the rotor 3 can be adjusted.

The first tool 61 can be inserted through the opening OP in the upper portion of the vacuum pump 1, and with the first tool 61, the magnet nut 46 can be held and rotated from the upper surface 51*b* side of the main body portion 51.

Note that in description below, a portion of the balance adjustment housing 70 corresponding to the first permanent magnet 41 of the vacuum pump 1 will be referred to as a "third permanent magnet 41'." Moreover, a portion of the balance adjustment housing 70 corresponding to the magnet holder 16 of the vacuum pump 1 will be referred to as a "magnet holder 16'," and a portion corresponding to the beam portion 16*b* will be referred to as a "beam portion 16*b'*."

<3. First Tool>

Figure 8:
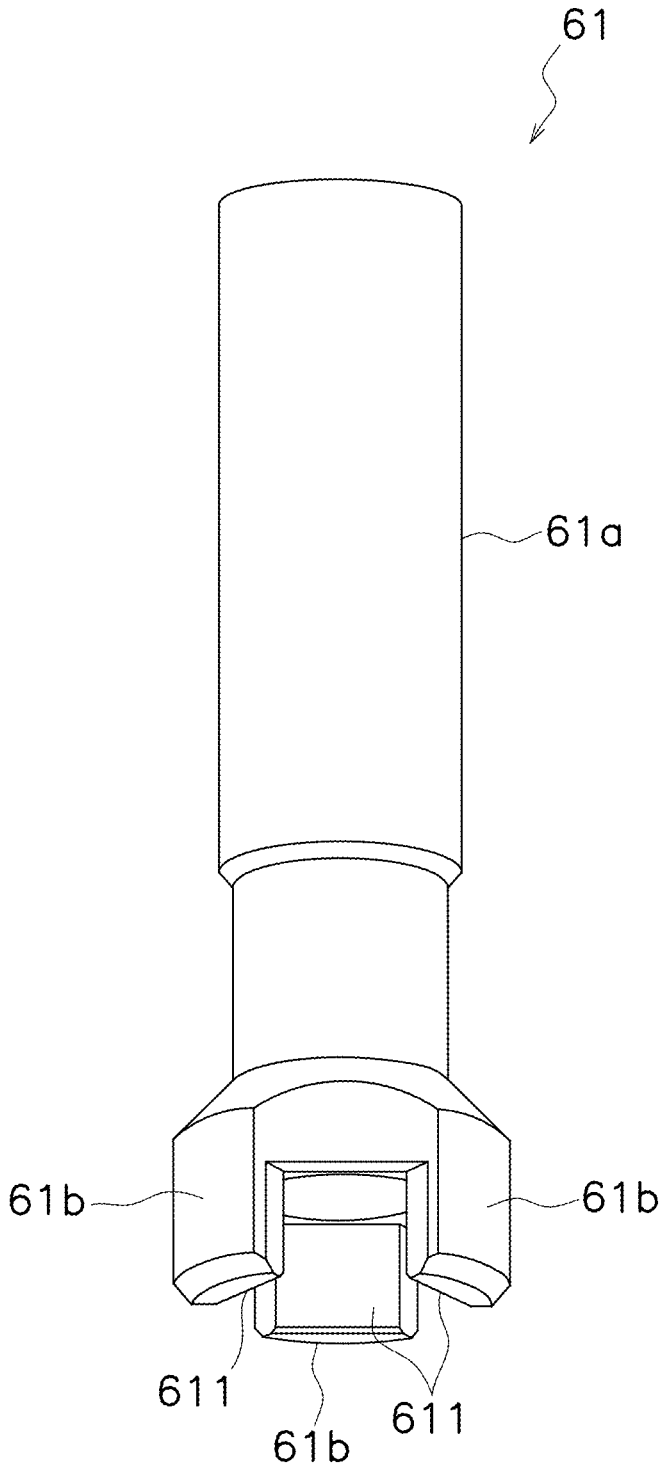
FIG. 8 is a view showing the configuration of a first tool.

Hereinafter, the first tool 61 will be described with reference to FIG. 8. FIG. 8 is a view showing the configuration of the first tool 61. The first tool 61 is a tool used when the main body portion 51 is rotated from the upper surface 51*b* side of the main body portion 51 of the magnet nut 46. The first tool 61 has a first gripping portion 61*a* and three first contact portions 61*b*.

The first gripping portion 61*a* is a rod-shaped member elongated in one direction. The first gripping portion 61*a* has, for example, a cylindrical shape elongated in one direction. The first gripping portion 61*a* is gripped by the user when the main body portion 51 is rotated with the first tool 61.

Each of the three first contact portions 61*b* is a portion branched from one end of the first gripping portion 61*a* in the longitudinal direction thereof and extending in the longitudinal direction of the first gripping portion 61*a*. The three first contact portions 61*b* are arranged at equal intervals in the circumferential direction of the first gripping portion 61*a*. Each first contact portion 61*b* has a contact surface 611. The contact surface 611 contacts the first contact target surface 53*a* and the second contact target surface 53*b* of the protrusion 52 of the magnet nut 46 when the first tool 61 is inserted from the upper surface 51*b* side of the main body portion 51.

Figure 9:
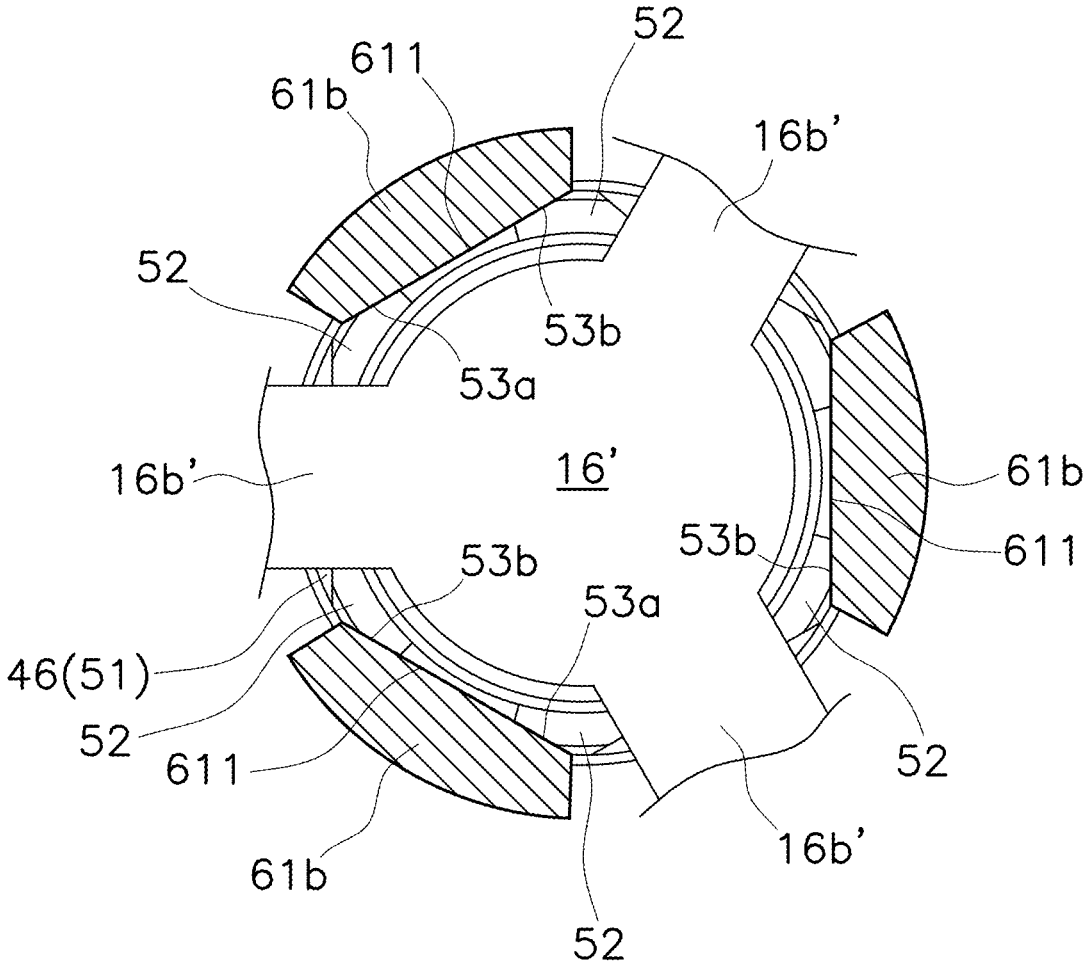
FIG. 9 is a view showing a state of the magnet nut being held with the first tool.

The first tool 61 having the above-described configuration is used in a case where the position of the magnet nut 46 is adjusted when the rotor 3 is housed in the balance adjustment housing 70 and the magnet nut 46 is attached thereto. Specifically, the first tool 61 is inserted from the upper surface 51*b* side of the main body portion 51 through the opening OP of the housing 2', and each first contact portion 61*b* of the first tool 61 is inserted into a space formed between adjacent two of the beam portions 16*b'*. Adjacent two of the six protrusions 52 provided on the upper surface 51*b* of the main body portion 51 of the magnet nut 46 can be visually recognized through each space into which a corresponding one of the first contact portions 61*b* is inserted. As described above, the first contact target surface 53*a* of one of adjacent two of the protrusions 52 and the second contact target surface 53*b* of the other protrusion 52 are adjacent to each other, and are arranged on one side of the hexagon formed by the six protrusions 52. Thus, in a case where the first contact portion 61*b* is inserted between the two beam portions 16*b'*, the contact surface 611 of the first contact portion 61*b* contacts the first contact target surface 53*a* of one of adjacent two of the protrusions 52 and the second contact target surface 53*b* of the other protrusion 52, as shown in FIG. 9. FIG. 9 is a view showing a state of the magnet nut 46 being held with the first tool 61.

As shown in, e.g., FIGS. 4 to 6, the first contact target surface 53*a* of one of adjacent two of the protrusions 52 and the second contact target surface 53*b* of the other protrusion 52 are apart from each other. Thus, each first contact portion 61*b* of the first tool 61 contacts the first contact target surface 53*a* and the second contact target surface 53*b* adjacent to each other as described above, and therefore, can hold the main body portion 51 at distant two points. As a result, the first tool 61 can stably hold the main body portion 51 (magnet nut 46).

<4. Second Tool>

Figure 10:
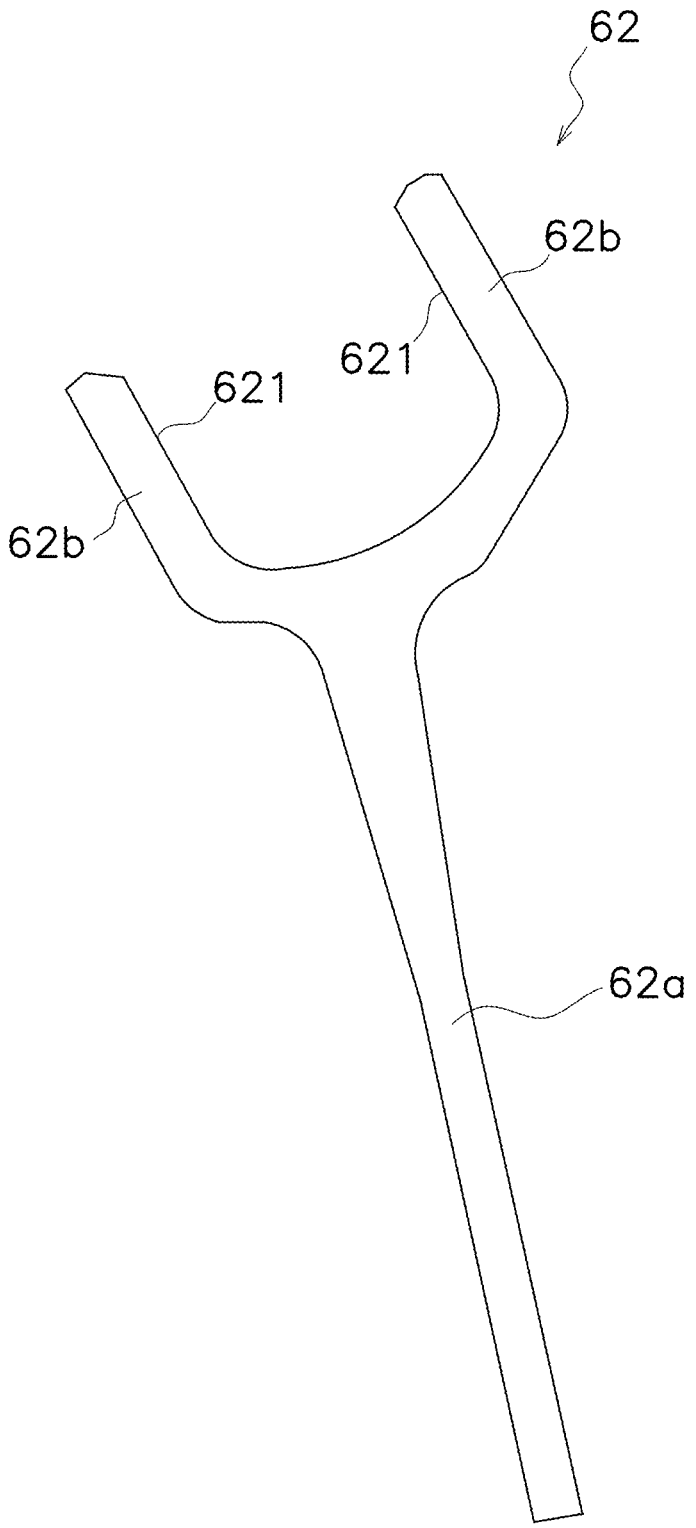
FIG. 10 is a view showing the configuration of a second tool.

Hereinafter, the second tool 62 will be described with reference to FIG. 10. FIG. 10 is a view showing the configuration of the second tool 62. The second tool 62 is a tool used when the main body portion 51 is rotated from the side-surface side (outer periphery 51*c* side) of the main body portion 51 of the magnet nut 46. The second tool 62 has a second gripping portion 62*a* and two second contact portions 62*b*.

The second gripping portion 62*a* is a member elongated in one direction. The second gripping portion 62*a* is, for example, a plate-shaped member long in one direction. The second gripping portion 62*a* is gripped by the user when the main body portion 51 is rotated with the second tool 62.

Each of the two second contact portions 62*b* is branched from one end of the second gripping portion 62*a* in the longitudinal direction thereof, and extends in the longitudinal direction of the second gripping portion 62*a*. The two second contact portions 62*b* are greater than the diameter of the inner periphery 51*a* of the main body portion 51 of the magnet nut 46 and smaller than the diameter of the outer periphery 51*c*. Each second contact portion 62*b* has a contact surface 621. The contact surface 621 contacts the first contact target surface 53*a* and the second contact target surface 53*b* of the protrusions 52 of the magnet nut 46 when the second tool 62 is inserted from the outer periphery 51*c* side of the main body portion 51.

Figure 11:
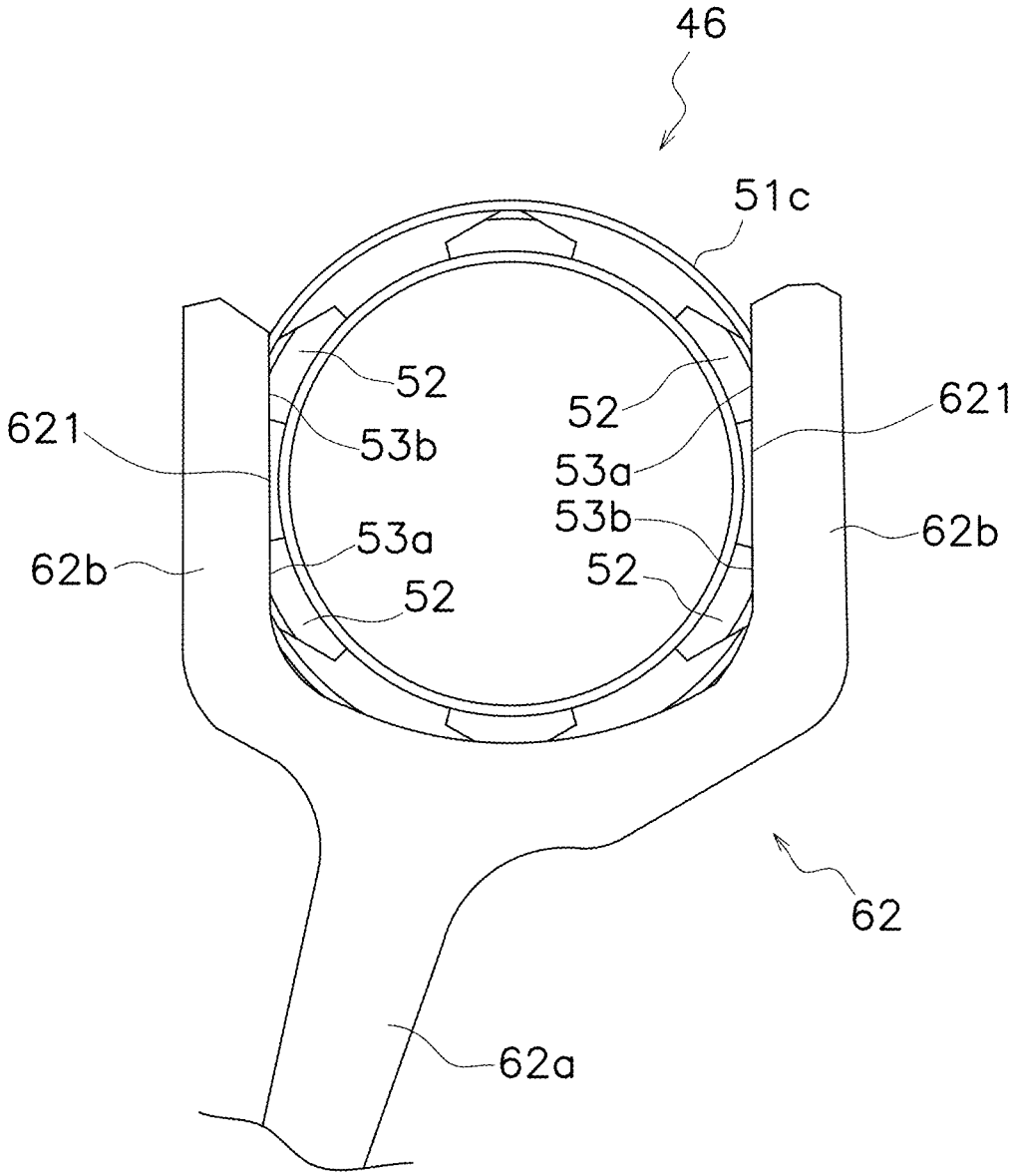
FIG. 11 is a view showing a state of the magnet nut being held with the second tool.

The second tool 62 having the above-described configuration is used in a case where the position of the magnet nut 46 is adjusted when the rotor 3 is housed in the housing 2 of the vacuum pump 1 and the magnet nut 46 is attached thereto. Specifically, as shown in FIG. 11, the second tool 62 is inserted from the outer periphery 51*c* side of the main body portion 51 through the first suction port P11 of the vacuum pump 1, and the four protrusions 52 are sandwiched by the two second contact portions 62*b* of the second tool 62. The four protrusions 52 are sandwiched by the two second contact portions 62*b*, and accordingly, the contact surface 621 of each second contact portion 62*b* of the second tool 62 contacts the first contact target surface 53*a* of one of adjacent two of the sandwiched four protrusions 52 and the second contact target surface 53*b* of the other protrusion 52. In this manner, the magnet nut 46 can be held with the second tool 62 in a state of the four protrusions 52 being sandwiched by the two second contact portions 62*b*. FIG. 11 is a view showing a state of the magnet nut 46 being held with the second tool 62.

As described above, each second contact portion 62*b* of the second tool 62 contacts the first contact target surface 53*a* and the second contact target surface 53*b* adjacent to each other, so that the main body portion 51 can be held at distant two points. As a result, the second tool 62 can stably hold the main body portion 51 (magnet nut 46).

<5. Method of Adjusting Vacuum Pump>

Next, a method of adjusting the vacuum pump 1 will be described. Adjustment of the vacuum pump 1 includes adjustment of the balance of the rotor 3 and adjustment of the vacuum pump 1 in a state of the balance-adjusted rotor 3 being housed in the housing 2. Hereinafter, the method of adjusting the vacuum pump 1 will be described in detail.

First, in order to adjust the balance of the rotor 3, the rotor 3 is housed in the internal space of the balance adjustment housing 70. Moreover, the magnet nut 46 is attached to the magnet holder 16' of the balance adjustment housing 70. Thereafter, the magnet nut 46 is rotated relative to the magnet holder 16', and the position of the third permanent magnet 41' of the balance adjustment housing 70 relative to the second permanent magnet 42 of the rotor 3 is adjusted accordingly. In this manner, the preload applied to the rolling bearing 33' of the balance adjustment housing 70 can be adjusted. The preload applied to the rolling bearing 33' can be measured, for example, with a force gauge attached to the thrust nut 34' of the balance adjustment housing 70.

As described above, in order to access the balance adjustment hole 43*a* of the rotor 3, the opening OP is provided in the upper surface of the case 7' of the housing 2' of the balance adjustment housing 70. Thus, upon adjustment of the balance of the rotor 3, the first tool 61 for rotating the magnet nut 46 from the upper surface 51*b* side of the main body portion 51 is used for rotating the magnet nut 46 attached to the magnet holder 16'.

Specifically, the above-described first tool 61 is inserted into the internal space of the balance adjustment housing 70 through the opening OP in the upper portion of the balance adjustment housing 70, and accordingly, the contact surface 611 of each first contact portion 61*b* of the first tool 61 contacts the corresponding contact target surfaces 53*a*, 53*b* of the magnet nut 46 housed in the internal space of the balance adjustment housing 70. Specifically, as described with reference to FIG. 9, each first contact portion 61*b* of the first tool 61 is inserted into the space formed between adjacent two of the beam portions 16*b'* of the balance adjustment housing 70, and accordingly, the contact surface 611 of each first contact portion 61*b* contacts the first contact target surface 53*a* of one of adjacent two of the protrusions 52 and the second contact target surface 53*b* of the other protrusion 52.

In the above-described manner, the first gripping portion 61*a* of the first tool 61 is rotated about the axis in the longitudinal direction in a state of the magnet nut 46 being held with the first tool 61, and accordingly, the magnet nut 46 is rotated relative to the magnet holder 16'. In this manner, the position of the third permanent magnet 41' relative to the second permanent magnet 42 of the rotor 3 can be adjusted.

After adjustment of the position of the third permanent magnet 41' relative to the second permanent magnet 42 of the rotor 3, the balance of the rotor 3 is adjusted. Specifically, the screw is inserted into any of the plurality of balance adjustment holes 43*a* provided in the rotor 3 or the screw inserted into any of the balance adjustment holes 43*a* is detached, and in this manner, the position of the center of gravity of the rotor 3 in the radial direction (direction perpendicular to the axis A) and the circumferential direction is adjusted to make the position of the center of gravity of the rotor 3 coincide with the center position of the rotor 3. Note that the position of the center of gravity of the rotor 3 can be estimated based on vibration generated upon rotation of the rotor 3 about the axis A, for example.

After adjustment of the balance of the rotor 3, the balance-adjusted rotor 3 and the magnet nut 46 are set into the vacuum pump 1. Specifically, the balance-adjusted rotor 3 is housed in the housing 2 of the vacuum pump 1, and the magnet nut 46 is attached to the magnet holder 16 of the vacuum pump 1. Thereafter, the magnet nut 46 is rotated relative to the magnet holder 16, and in this manner, the position of the first permanent magnet 41 of the vacuum pump 1 relative to the second permanent magnet 42 of the rotor 3 is adjusted. In this manner, the preload applied to the rolling bearing 33 of the vacuum pump 1 can be adjusted. The preload applied to the rolling bearing 33 can be measured, for example, with the force gauge attached to the thrust nut 34 of the vacuum pump 1.

As described above, in the vacuum pump 1, the upper surface of the case 7 of the housing 2 is closed with the first end portion 11. Thus, in a case where the rotor 3 is housed in the housing 2 of the vacuum pump 1, an access to the magnet nut 46 with the first tool 61 cannot be made. On the other hand, the first suction port P11 is provided in the side portion 13 of the housing 2. An access to the magnet nut 46 from the side-surface side (outer periphery 51*c* side) of the main body portion 51 can be made through the first suction port P11. Thus, in a case where the balance-adjusted rotor 3 is set into the vacuum pump 1, the second tool 62 for rotating the magnet nut 46 from the outer periphery 51*c* side of the main body portion 51 is used for rotating the magnet nut 46 attached to the magnet holder 16.

Specifically, the second tool 62 described above is inserted into the internal space of the housing 2 through the first suction port P11 provided in the side portion 13 of the housing 2, and accordingly, the contact surface 621 of each second contact portion 62*b* of the second tool 62 contacts the contact target surfaces 53*a*, 53*b* of the magnet nut 46 housed in the internal space of the housing 2. Specifically, as described with reference to FIG. 11, the four protrusions 52 of the magnet nut 46 are sandwiched by the two second contact portions 62*b* of the second tool 62, and accordingly, the contact surface 621 of each second contact portion 62*b* contacts the first contact target surface 53*a* of one of adjacent two of the sandwiched four protrusions 52 and the second contact target surface 53*b* of the other protrusion 52.

The second gripping portion 62*a* of the second tool 62 is moved in the horizontal direction in a state of the magnet nut 46 being held with the second tool 62 in the above-described manner, and accordingly, the magnet nut 46 is rotated relative to the magnet holder 16. In this manner, the position of the first permanent magnet 41 relative to the second permanent magnet 42 of the rotor 3 can be adjusted. In the above-described manner, the balance-adjusted rotor 3 and the magnet nut 46 can be set into the vacuum pump 1.

In the above-described vacuum pump 1, the protrusion 52 protruding from the upper surface 51*b* of the main body portion 51 of the magnet nut 46 for adjusting the positions of the first permanent magnet 41 and the third permanent magnet 41' has the contact target surfaces 53*a*, 53*b* with which the tool for rotating the main body portion 51 is to contact. The contact target surfaces 53*a*, 53*b* are provided on the outer periphery 51*c* side of the main body portion 51 at the protrusion 52, and not only the first tool 61 for rotating the main body portion 51 from the upper surface 51*b* side of the main body portion 51 but also the second tool 62 for rotating the main body portion 51 from the side-surface side (outer periphery 51*c* side) of the main body portion 51 can contact the contact target surfaces 53*a*, 53*b*. As described above, the magnet nut 46 can be rotated not only from the upper-surface side but also from the side-surface side of the main body portion 51, and therefore, the positions of the first permanent magnet 41 and the third permanent magnet 41' can be adjusted not only from the upper-surface side but also from the side-surface side of the magnet nut 46.

For example, in a case where the rotor 3 is housed in the balance adjustment housing 70 provided with the opening OP in the upper portion of the housing 2', i.e., upon adjustment of the balance of the rotor 3, the position of the third permanent magnet 41' can be adjusted from above the balance adjustment housing 70 with the first tool 61 for rotating the main body portion 51 from the upper surface 51*b* side of the main body portion 51.

On the other hand, in a case where the rotor 3 is housed in the housing 2 of the vacuum pump 1 provided with the first suction port P11 in the side portion 13, i.e., upon setting of the rotor 3 into the vacuum pump 1, the position of the first permanent magnet 41 can be adjusted from the side of the vacuum pump 1 with the second tool 62 for rotating the main body portion 51 from the side-surface side (outer periphery 51*c* side) of the main body portion 51.

2. Other Embodiments

One embodiment of the present invention has been described above, but the present invention is not limited to the above-described embodiment and various changes can be made without departing from the gist of the invention.

In the above-described embodiment, the six protrusions 52 are provided on the upper surface 51*b* of the main body portion 51 of the magnet nut 46, but the present invention is not limited thereto. The number of protrusions 52 is only required to be the multiple of six, and for example, may be 12 or 18.

The number of protrusions 52 and/or the shape (the number of vertices) of the polygon formed by the protrusions 52 and the contact target surfaces 53*a*, 53*b* can be arbitrarily set depending on, e.g., whether to provide the beam portions 16*b* in the magnet holder 16 or the number of beam portions 16*b* (i.e., the number of spaces formed by the beam portions 16*b*).

In the above-described embodiment, the plurality (six) of protrusions 52 is arranged at predetermined intervals on the upper surface 51*b* of the main body portion 51 to form part of the polygonal shape. The present invention is not limited thereto, and one protrusion 52 having the polygonal shape as a whole may be arranged on the upper surface 51*b* of the main body portion 51.

Figure 12:
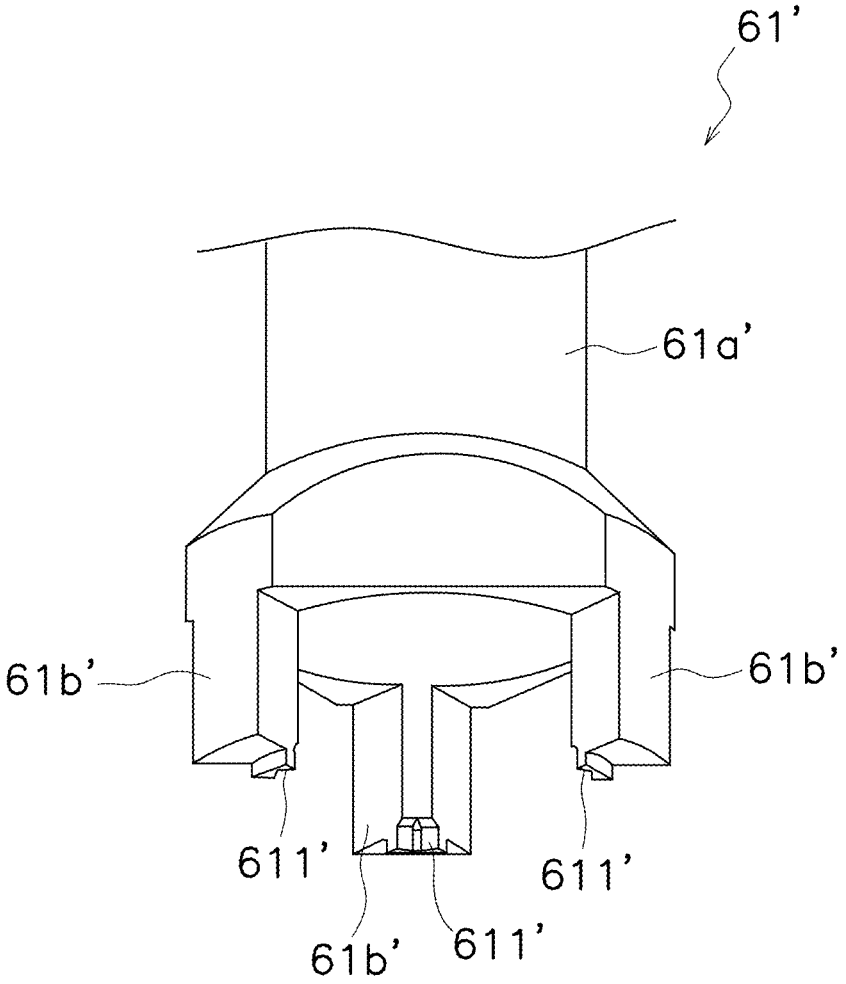
FIG. 12 is a view showing a first tool of another embodiment.

The first tool 61 for rotating the magnet nut 46 from the upper surface 51*b* side of the main body portion 51 is not limited to the configuration described with reference to FIGS. 7 and 8. For example, a first tool 61' may have a configuration as shown in FIG. 12. FIG. 12 is a view showing the first tool 61' of another embodiment. The first tool 61' has a third gripping portion 61*a*' and three third contact portions 61*b*'.

The third gripping portion 61*a*' is a rod-shaped member elongated in one direction. The third gripping portion 61*a*' is gripped by a user when the main body portion 51 is rotated with the first tool 61'.

Each of the three third contact portions 61*b*' is a portion branched from one end of the third gripping portion 61*a*' in the longitudinal direction thereof and extending in the longitudinal direction of the third gripping portion 61*a*'. The three third contact portions 61*b*' are arranged at equal intervals in the circumferential direction of the third gripping portion 61*a*'. Each third contact portion 61*b*' has a contact surface 611'. The contact surface 611' has a shape corresponding to a vertex portion of the protrusion 52 of the magnet nut 46. The contact surface 611' contacts a portion of the contact target surface (first contact target surface 53*a*, second contact target surface 53*b*) of one protrusion 52 of the magnet nut 46 corresponding to the vertex of the hexagon when the first tool 61' is inserted from the upper surface 51*b* side of the main body portion 51. That is, the contact surface 611' contacts a vertex portion of one protrusion 52.

Figure 13:
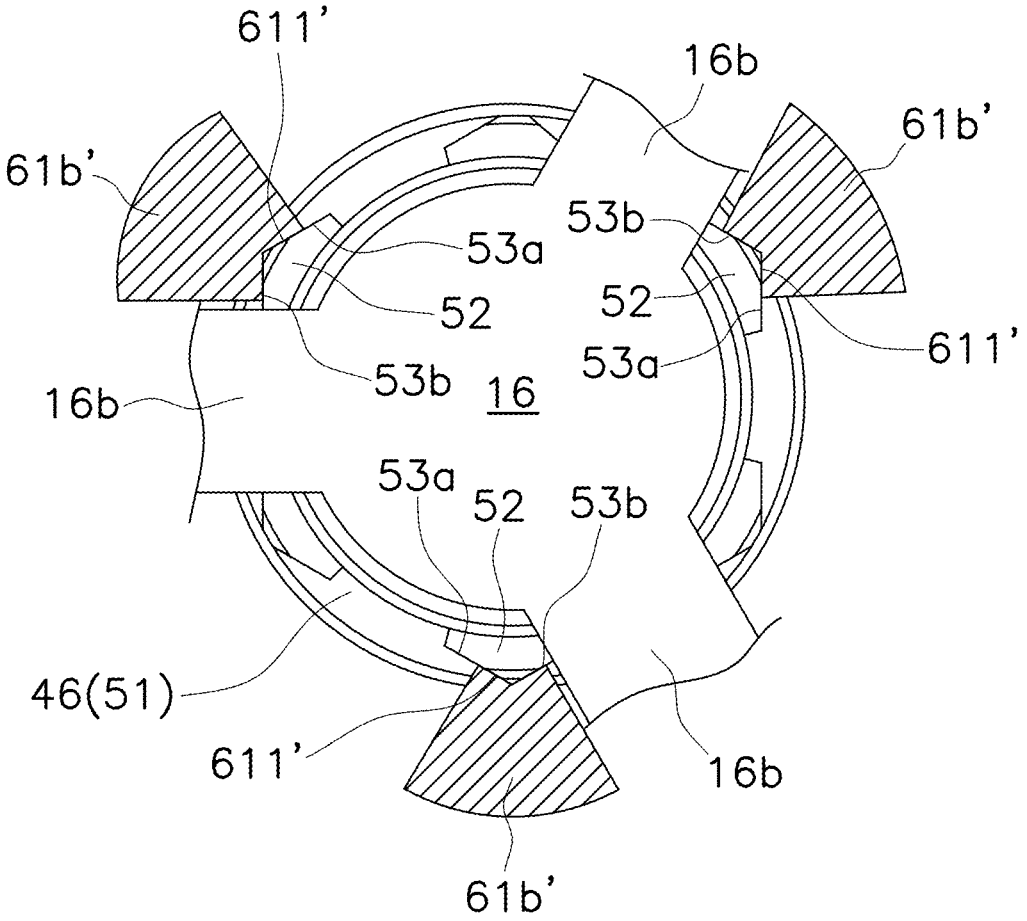
FIG. 13 is a view showing a state of the magnet nut being held with the first tool of the another embodiment.

In a case where the magnet nut 46 attached to the balance adjustment housing 70 is held and rotated with the first tool 61' having the above-described configuration, the first tool 61' is inserted from the upper surface 51*b* side of the main body portion 51 through the opening OP of the balance adjustment housing 70, and each third contact portion 61*b*' of the first tool 61' is inserted into the space formed between adjacent two of the beam portions 16*b*'. Next, as shown in FIG. 13, the contact surface 611' of each third contact portion 61*b*' contacts the first contact target surface 53*a* and the second contact target surface 53*b* at the vertex portion of one protrusion 52. FIG. 13 is a view showing a state of the magnet nut 46 being held with the first tool 61' of the another embodiment.

As shown in FIG. 13, the third contact portion 61*b*' of the first tool 61' is narrowed as compared to the first contact portion 61*b* of the first tool 61 described in the first embodiment. Thus, the third contact portion 61*b*' can be more greatly moved in the space between adjacent two of the beam portions 16*b*'. As a result, the first tool 61' can rotate the magnet nut 46 over a wide angular range without re-holding the magnet nut 46 once the first tool 61' is inserted into the balance adjustment housing 70. That is, the first tool 61' can adjust the position of the magnet nut 46 (i.e., position of the third permanent magnet 41') without re-holding the magnet nut 46.

3. Aspects

Those skilled in the art understand that the above-described exemplary embodiments are specific examples of the following aspects.

(First Aspect) A vacuum pump includes a rotor, a housing, a magnetic bearing, and an adjustment member. The rotor is rotatable. The housing houses the rotor. The magnetic bearing has a first magnet arranged at the periphery of a magnet holder fixed to the housing and a second magnet arranged in the rotor to face the first magnet in a radial direction. The adjustment member adjusts the position of the first magnet relative to the second magnet. The adjustment member has a main body portion and a protrusion. The main body portion has, in the inner peripheral surface thereof, a second thread shape to be fitted in a first thread shape formed at the periphery of the magnet holder, and is moved in a direction along the rotation axis of the rotor by rotating relative to the magnet holder to adjust the position of the first magnet relative to the second magnet. The protrusion protrudes from the upper surface of the main body portion. The protrusion has, on the outer peripheral side of the main body portion, a contact target surface contactable with a first tool configured to rotate the main body portion from the upper-surface side of the main body portion and contactable with a second tool configured to rotate the main body portion from the side-surface side of the main body portion.

In the vacuum pump according to the first aspect, the protrusion protruding from the upper surface of the main body portion of the adjustment member for adjusting the position of the first magnet has the contact target surface contactable with the tool for rotating the main body portion. The contact target surface is provided on the outer peripheral side of the main body portion at the protrusion, and is contactable not only with the first tool for rotating the main body portion from the upper-surface side of the main body portion but also with the second tool for rotating the main body portion from the side-surface side of the main body portion. As described above, the adjustment member can be rotated with the tool not only from the upper-surface side but also from the side-surface side of the main body portion, and therefore, the position of the first magnet can be adjusted not only from the upper-surface side but also from the side-surface side of the adjustment member.

(Second Aspect) In the vacuum pump according to the first aspect, the protrusion may have a polygonal shape as viewed from the upper-surface side of the main body portion. In the vacuum pump according to the second aspect, the adjustment member can be stably held and rotated with the tool.

(Third Aspect) In the vacuum pump according to the second aspect, the protrusion may include a plurality of protrusions arranged on the upper surface of the main body portion. In this case, the plurality of protrusions may form part of the polygonal shape. In the vacuum pump according to the third aspect, the adjustment member can be stably held and rotated with the tool while the protrusion is reduced in size.

(Fourth Aspect) In the vacuum pump according to the third aspect, each of the plurality of protrusions may be arranged at the position of the vertex of the polygonal shape on the upper surface of the main body portion. In the vacuum pump according to the fourth aspect, the adjustment member can be stably held and rotated with the tool while the protrusion is reduced in size.

(Fifth Aspect) In the vacuum pump according to the third or fourth aspect, the first tool and the second tool may contact a contact target surface of any of the plurality of protrusions and a contact target surface of a protrusion adjacent to the any of the plurality of protrusions. In the vacuum pump according to the fifth aspect, the adjustment member can be held at distant two points with the tool, and therefore, the adjustment member can be stably held and rotated.

(Sixth Aspect) In the vacuum pump according to the fourth aspect, the first tool may contact a portion of the contact target surface of the protrusion corresponding to the vertex of the polygonal shape. In the vacuum pump according to the sixth aspect, the position of the adjustment member can be adjusted with the first tool over a wide range without re-holding the adjustment member.

(Seventh Aspect) In the vacuum pump according to any one of the third to sixth aspects, the number of the protrusions arranged on the upper surface of the main body portion may be the multiple of six. In the vacuum pump according to the seventh aspect, for example, the protrusions can be stably held with the first tool at three points, and can be stably held with the second tool at two points.

(Eighth Aspect) A method of adjusting the vacuum pump according to any one of the first to seventh aspects includes:

housing the rotor and the adjustment member in an adjustment housing having an opening in an upper portion and a third magnet;

inserting a first tool into the adjustment housing through the opening, rotating the adjustment member with the first tool contacting the contact target surface of the adjustment member housed in the adjustment housing, and adjusting the position of the third magnet relative to the second magnet;

housing the rotor and the adjustment member in the housing of the vacuum pump formed with a suction port in a side surface; and adjusting the position of the first magnet relative to the second magnet by inserting a second tool into the housing through the suction port, and rotating the adjustment member with the second tool contacting the contact target surface of the adjustment member housed in the housing.

In the method of adjusting the vacuum pump according to the eighth aspect, in a case where the rotor and the adjustment member are housed in the adjustment housing provided with the opening in the upper portion, the position of the third magnet can be adjusted from above the adjustment housing with the first tool for rotating the adjustment member from the upper-surface side of the main body portion. On the other hand, in a case where the rotor and the adjustment member are housed in the housing of the vacuum pump provided with the suction port in the side portion, the position of the first magnet can be adjusted from the side of the vacuum pump with the second tool for rotating the main body portion from the side-surface side of the main body portion.

(Ninth Aspect) The adjustment method according to the eighth aspect may further include adjusting the balance of the rotor after adjusting the position of the third magnet relative to the second magnet. In the adjustment method according to the ninth aspect, the balance of the rotor can be adjusted, and therefore, vibration upon operation of the vacuum pump can be reduced.

What is claimed is:

1. A vacuum pump comprising:

a rotatable rotor;

a housing configured to house the rotor;

a magnetic bearing having a first magnet arranged at a periphery of a magnet holder fixed to the housing and a second magnet arranged in the rotor to face the first magnet in a radial direction; and an adjustment member configured to adjust a position of the first magnet relative to the second magnet, the adjustment member having:

a main body portion having, in an inner peripheral surface thereof, a second thread shape to be fitted in a first thread shape formed at the periphery of the magnet holder and moved in a direction along a rotation axis of the rotor by rotating relative to the magnet holder to adjust the position of the first magnet relative to the second magnet, and a protrusion protruding from an upper surface of the main body portion, and the protrusion having, on an outer peripheral side of the main body portion, a contact target surface contactable with a first tool configured to rotate the main body portion from an upper-surface side of the main body portion and contactable with a second tool configured to rotate the main body portion from a side-surface side of the main body portion.

2. The vacuum pump according to claim 1, wherein the protrusion has a polygonal shape as viewed from the upper-surface side of the main body portion.

3. The vacuum pump according to claim 2, wherein the protrusion includes a plurality of protrusions arranged on the upper surface of the main body portion, and the plurality of protrusions forms part of the polygonal shape.

4. The vacuum pump according to claim 3, wherein each of the plurality of protrusions is arranged at a position of a vertex of the polygonal shape on the upper surface of the main body portion.

5. The vacuum pump according to claim 3, wherein the first tool and the second tool contact a contact target surface of any of the plurality of protrusions and a contact target surface of a protrusion adjacent to the any of the plurality of protrusions.

6. The vacuum pump according to claim 4, wherein the first tool contacts a portion of a contact target surface of each of the plurality of protrusions corresponding to the vertex of the polygonal shape.

7. The vacuum pump according to claim 3, wherein the number of the protrusions arranged on the upper surface of the main body portion is a multiple of six.

8. A method of adjusting the vacuum pump according to claim 1, comprising:

housing the rotor and the adjustment member in an adjustment housing having an opening in an upper portion and a third magnet;

adjusting a position of the third magnet relative to the second magnet by inserting a first tool into the adjustment housing through the opening, and rotating the adjustment member with the first tool contacting the contact target surface of the adjustment member housed in the adjustment housing;

housing the rotor and the adjustment member in the housing of the vacuum pump formed with a suction port in a side surface; and adjusting the position of the first magnet relative to the second magnet by inserting a second tool into the housing through the suction port, and rotating the adjustment member with the second tool contacting the contact target surface of the adjustment member housed in the housing.

9. The adjustment method according to claim 8, further comprising:

adjusting a balance of the rotor after adjusting the position of the third magnet relative to the second magnet.

* * * * *